United States Patent [19]

Uyeda et al.

[11] 4,339,125

[45] Jul. 13, 1982

[54] SINGLE COLUMN EXERCISING APPARATUS

[75] Inventors: Tim M. Uyeda, South San Gabriel; Parker E. Mahnke, Glendale, both of Calif.

[73] Assignee: Marcy Gymnasium Equipment Co., Alhambra, Calif.

[21] Appl. No.: 104,885

[22] Filed: Dec. 18, 1979

[51] Int. Cl.[3] ..... A63B 23/02

[52] U.S. Cl. ..... 272/118

[58] Field of Search ..... 272/93, 116, 117, 118, 272/122, 123, 134, 127, 144; 73/379

[56] References Cited

U.S. PATENT DOCUMENTS

| | | | |
|---|---|---|---|
| 3,589,720 | 6/1971 | Agamian | 272/134 X |
| 3,635,472 | 1/1972 | Marcyan | 272/118 |
| 3,807,728 | 4/1974 | Chillier | 272/118 |
| 3,840,227 | 10/1974 | Chesemore | 272/118 |
| 3,912,263 | 10/1975 | Yatso | 272/118 |
| 3,971,555 | 7/1976 | Mahnke | 272/118 |
| 4,010,947 | 3/1977 | Lambert | 272/118 |
| 4,199,139 | 4/1980 | Mahnke et al. | 272/118 |
| 4,200,280 | 4/1980 | Goodwin | 272/118 |

FOREIGN PATENT DOCUMENTS

| | | | |
|---|---|---|---|
| 2142569 | 3/1973 | Fed. Rep. of Germany | 272/127 |
| 2417258 | 1/1975 | Fed. Rep. of Germany | 272/118 |
| 1003973 | 11/1951 | France | 272/118 |
| 1444065 | 5/1966 | France | 272/118 |

*Primary Examiner*—Richard J. Apley

*Attorney, Agent, or Firm*—James E. Brunton

[57] ABSTRACT

A progressive resistance exercising machine having a single, substantially vertical guide column adapted to guide a reciprocating member which is provided with a laterally outwardly extending lifting arm engageable by the trainee. Both the guide column and a weight selector bar to which the reciprocating member is connected extends through centrally disposed apertures formed in a plurality of weights positioned substantially directly below the selector bar. When the selector bar is selectively interconnected with one or more weights in the weight stack, a lifting force exerted on the lifting arm will cause the reciprocating member and the selector bar to move upwardly against the urging of the weights. As the reciprocating member is moved upwardly, the central guide column accomplishes the function of uniquely guiding the travel of both the reciprocating member and the selector bar as well as constraining the path of travel of the weights. The vertical starting height of lifting arm can be adjusted by interconnecting the reciprocating member with the selector bar at various vertically spaced apart connecting points along the selector bar.

10 Claims, 7 Drawing Figures

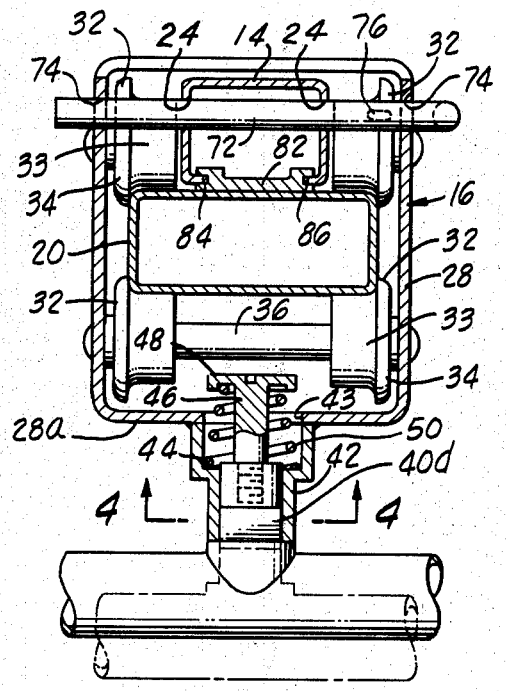
FIG. 3.
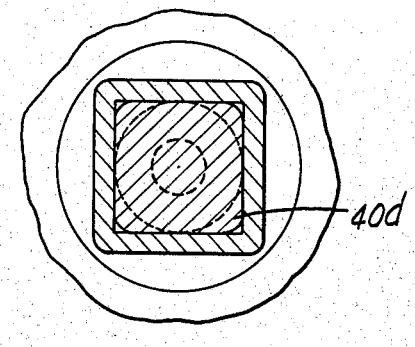
FIG. 4.
FIG. 5.
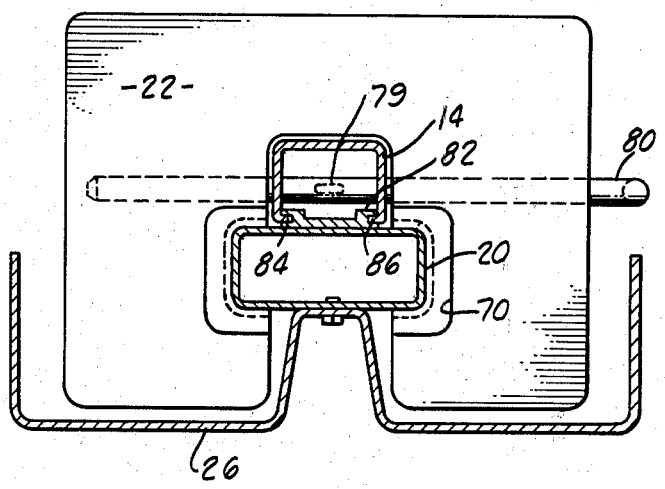
FIG. 6.
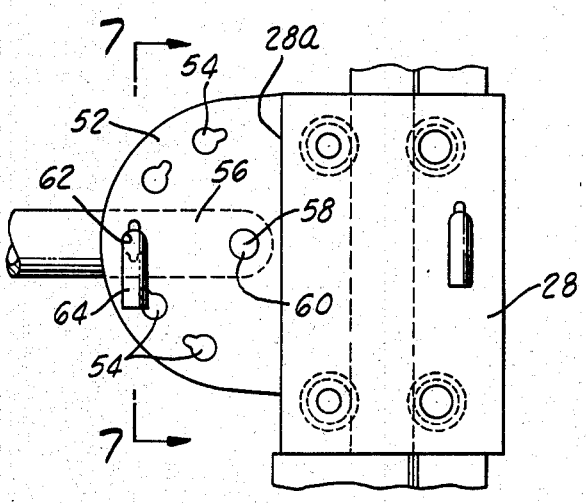
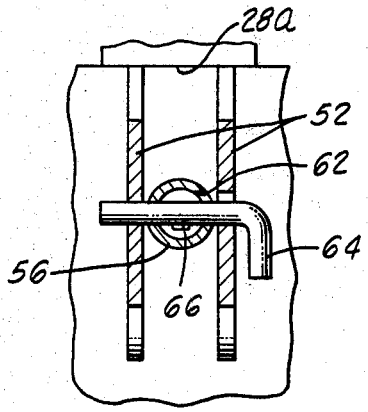
FIG. 7.

SINGLE COLUMN EXERCISING APPARATUS

BACKGROUND OF THE INVENTION

1. Field of the Invention

The present invention relates generally to exercising apparatus and more particularly to a compact, wall mounted exercising machine for accomplishing progressive resistance exercises.

2. Discussion of the Prior Art

The therapeutic value of progressive resistance exercises has long been recognized. Exercising muscles against progressively increasing weights not only results in added strength and endurance in the muscles, but also in the improvement of neuromuscular coordination and in a more efficient functioning of the cardiovascular and respiratory systems.

Traditionally apparatus such as dumbbells and barbells have been used for progressive exercises. The use of such apparatus, however, can be extremely dangerous when undertaken without proper training and supervision. When a large amount of weight is being lifted, barbells are particularly dangerous and present difficult balancing problems. If they are dropped, serious injury can result to the trainee or to those about him.

In the past, various types of progressive weight training machines have been suggested to overcome the drawbacks of barbells and dumbbells. However, to provide the required versitility and insure trainee safety such machines have typically been quite large and bulky and have required substantial amounts of floor space.

Among the most successful prior art devices known to applicant are those described in U.S. Pat. No. 3,971,555, in U.S. Pat. No. Re. 28,066 and in applicants' copending application Ser. No. 051,049. Applicant is also familiar with U.S. Pat. Nos. 3,905,599 and 3,912,263. The aforementioned patents represent the most pertenent art known to applicant and serve to illustrate the novelty of the apparatus of the present invention.

SUMMARY OF THE INVENTION

It is an object of the present invention to provide an improved, wall mounted progressive resistance exercise machine which is simpler, less bulky, and less weighty than prior art machines making it ideally suited for use in homes, apartments and offices as well as in gymnasiums.

More particularly, it is an object of the invention to provide an exercise machine of the aforementioned character which includes a substantially vertically disposed selector bar, a reciprocating member interconnectable with the selector bar at various vertically spaced apart points along the selector bar and a plurality of apertured weights disposed substantially below the selector bar and interconnectable therewith. The machine also includes a single central column which not only functions to guide vertical travel of the selector bar and the reciprocating member, but also functions to guide vertical travel of the weights.

Another object of the invention is to provide a machine of the type described in which a lifting arm engageable by a trainee extends from the reciprocating member, the vertical starting height of which is adjustable by selecting the point of interconnection of the reciprocating member with the selector bar.

Another object of the invention is to provide a machine as described in the preceeding paragraph in which the vertical starting height of the handle portions of the lifting arm is variable by adjustment of the lifting arm with respect to the reciprocating member.

Still another object is to provide such a machine which embodies a minimum number of component parts, does not utilize ropes, cables, pulleys or the like and, therefore, is smoother, safer and more positive in operation.

The superior engineering design and overall simplicity and compactness of the machine of the present invention permits it to be inexpensively manufactured, easily set up and operated in numerous locations, and to be safely used even by unskilled persons with a minimum of training.

BRIEF DESCRIPTION OF THE DRAWINGS

FIG. 3 is a cross-sectional view taken along lines 3—3 of FIG. 2 illustrating the construction of the body engaging means and its method of connection to the reciprocating member.

FIG. 4 is a view taken along lines 4—4 of FIG. 3 illustrating one means of interconnection of the lifting arm with the reciprocating member.

FIG. 5 is a cross-sectional view taken along lines 5—5 of FIG. 2.

FIG. 6 is a fragmentary side elevational view showing another means of interconnection between the lifting arm and the reciprocating member of the invention.

FIG. 7 is a cross-sectional view taken along lines 7—7 of FIG. 6.

DESCRIPTION OF THE INVENTION

Figure 1:
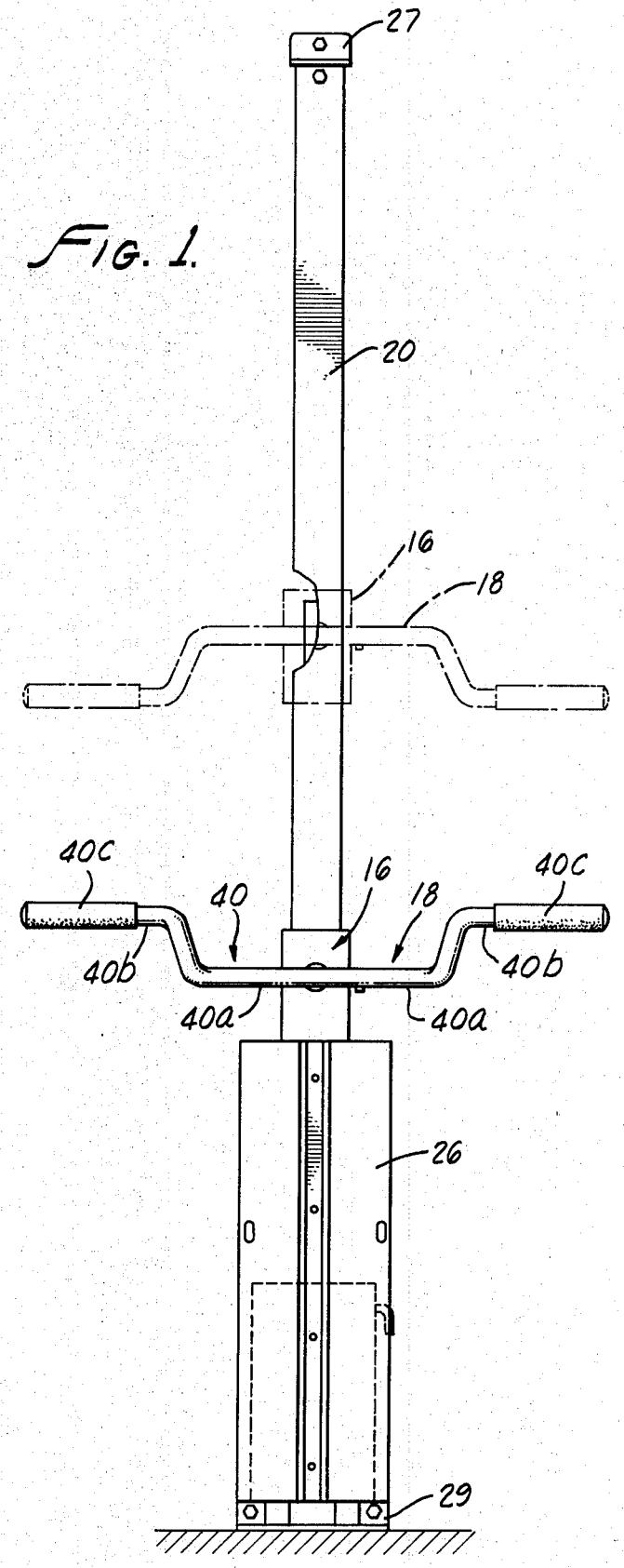
FIG. 1 is a front elevational view of the single column exercising apparatus of the invention.
Figure 2:
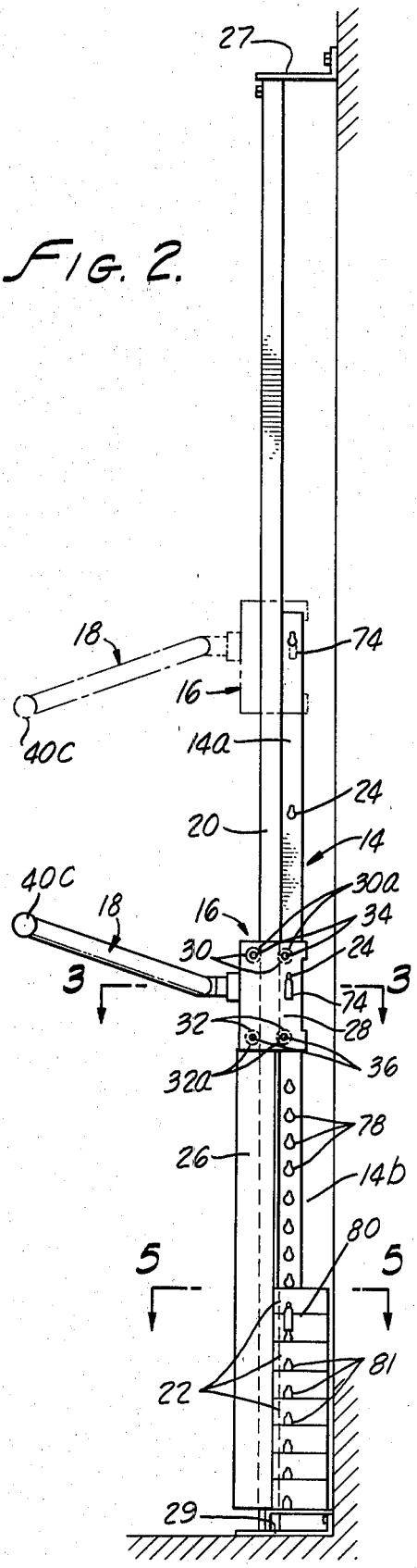
FIG. 2 is a side elevational view of the apparatus.

Referring to the drawings, and particularly to FIGS. 1 through 5, one form of the exercising apparatus of the invention comprises a substantially vertically disposed selector bar 14, a reciprocating means, shown here as assembly 16 which is connected to bar 14, body engaging means 18 projecting laterally outward from assembly 16 and biasing means in the form of a stack of weights 22 for biasing selector bar 14 against upward movement by forces exerted on the body engaging means. As best seen in FIG. 2, assembly 16 can be interconnected with selector bar 14 at various vertically spaced points 24 along the selector bar. The phantom lines of FIGS. 1 and 2 illustrate the assembly 16 connected to the selector bar 14 at the uppermost point. In a manner presently to be described, assembly 16 and one or more of the weights 22 of the weight stack can be interconnected by the selector bar 14.

Turning to FIG. 5, it can be seen that each of the weights 22 which make up the weight stack is apertured to closely receive both central guide column 20 and selector bar 14. This unique construction has numerous advantages, one of which is the elimination of the requirement for separate guide means for guiding the vertical travel of the weights within the apparatus. As also shown in FIG. 5, a protective means in the form of a rigid vertically extending shield member 26 is connected to the lower front surfaces of guide column 20 to shield the trainee from the weight stack. This protective shield precludes injury to the trainee or others should the weights accidentally be dropped during the performance of an exercise.

Referring once again to FIGS. 1 and 2, brackets 27 and 29 are provided at the top and bottom of vertical column 16 to conveniently attach the apparatus to a wall or other vertical structural member. When the apparatus is installed in the manner shown in the drawings, brackets 27 and 29 securely position the central guide column 20 in a spaced apart relationship with respect to the wall or other vertical structure. Because of the unique single column design of the apparatus, a minimum amount of floor space and wall area is required to install the apparatus. This feature, along with the simplicity of the design and maximum weight savings attributable thereto, permits the apparatus to be conveniently installed and used in homes, offices or apartments, as well as in gymnasiums.

Turning now to FIG. 3, assembly 16 is seen to comprise housing 28 adapted to carry first and second vertically spaced apart bearing or roller means. In the embodiment of the invention shown in the drawings, these latter means are provided in the form of upper and lower sets of wheel means 30 and 32 respectively (FIG. 2). Upper wheel means 30 include front and rear pair of rollers 30*a* which are coaxially mounted on horizontally spaced apart axles 34 carried by housing 28. Similarly lower wheel means 32 include front and rear pairs of rollers 32*a* which are coaxially mounted on horizontally spaced apart axle members 36 carried by housing 28. Rollers 30*a* and 32*a* are of identical configuration, each having hub portions 33 and flange portions 34 (FIG. 3).

Central guide column 20 is provided first and second guide means for guiding said bearing or roller means of the assembly 16. In the embodiment of the invention shown in the drawings, central guide column 20 is substantially rectangular in cross-section and said first and second guide means comprise front and rear guide surfaces which are rollably engaged by the hub portions 33 of rollers 30*a* and 32*a*. Central guide column 20 is also provided with guide surfaces of each side thereof, adapted to be rollably engaged by flange portions 34 of rollers 30*a* and 32*a*.

In the form of the invention shown in FIGS. 1 through 5, the body engaging means 18 comprises a lifting arm or handle bar structure 40 which is adjustably connected to housing 28 of assembly 16. Referring to FIG. 1, lifting arm 40 includes a central portion 40*a*, a pair of flared out portions 40*b* and a pair of handle portions 40*c*. As shown in FIGS. 3 and 4, extending rearwardly from central portion 40*a* is a substantially rectangular shaped hub portion 40*d* which is telescopically receivable in a forwardly extending, hollow member 42 affixed to the forward face 28*a* of housing 28. The forward portion of member 42 is generally rectangular in cross-section and the rearward portion is tubular in shape and is slightly enlarged so as to form an internal shoulder 44. Threadably connected to hub portion 40*d* is a pin 46 having an enlarged diameter head portion 48. As shown in FIG. 3, pin 46 extends rearwardly through an aperture 48 formed in face 28*a* of housing 28. Disposed intermediate head portion 48 of pin 46 and shoulder 44 of member 42 is a biasing means shown here as a coiled spring 50. Spring 50 is adapted to urge against the removal of hub portion 40*d* from seating engagement within the forward portion of member 42 so that the lifting arm is locked against withdrawal and against rotational movement with respect to housing 28. However, by pulling outwardly on the lifting arm against the urging of spring 50 hub portion 40*d* can be retracted from seating engagement within member 42. In its retracted position the lifting arm can be rotated with respect to housing 28 and can then be reinserted into seating engagement in a second orientation. As best seen in FIG. 2, since the flared out portions 40*b* of the lifting arm lie in a plane which is angularly disposed with respect to the plane of central portion 40*a* of the lifting arm, rotation of the lifting arm through an angle of 180° permits adjustment in the vertical starting height of the handle portions 40*c*. For example, the solid lines in FIG. 2 show the handle portions 40*c* in an elevated position relative to assembly 16. However, by rotating the lifting arm 180° in the manner just described and reseating hub portion 40*d* within member 42, the handle portions 40*c* can be lowered relative to assembly 16 as illustrated by the phantom lines of FIG. 2. In this way, fine adjustment in the vertical starting height of the body engaging means can be achieved.

Turning to FIGS. 6 and 7, there is shown another embodiment of the invention illustrating an alternate means for accomplishing fine adjustment in the vertical starting height of the body engaging means. In this form of the invention, a pair of outward protruding, transversely spaced apart semicircular plates 52 are affixed to the forward face 28*a* of housing 28. Each plate 52 is provided with a plurality of transversely aligned key shaped apertures 54 disposed along an arcuate path. In this embodiment, a central hub portion 56 extends rearwardly from the central portion 40*a* of the lifting arm. Hub 56 is adapted to be received between plates 52 for pivotal movement about an axis 58 defined by a pin 60 extending between the plates. An aperture 62 is formed in the hub portion at a point spaced from axis 58 for receiving a locking pin 64. As illustrated in FIG. 7, pin 64 includes a protuberance 66 located intermediate its ends. In one position of the locking pin protuberance 66 is freely receivable in the keyhole shaped apertures 54 so that the pin can be inserted through apertures 54 in plates 52 and also through aperture 62 in hub portion 56 of the lifting arm. In this way the pin can be used to lock the lifting arm in a particular angle orientation with respect to housing 28. By removing the locking pin, pivoting the lifting arm either upwardly or downwardly about axis 58 and then reinserting the locking pin into a selected aperture 54 the angular orientation of the lifting arm and the starting height of the body engaging means can be selectively adjusted. Due to the construction of the locking pin, when it is in place within apertures 54, the protuberance 66 will move by force of gravity into a position out of index with the keyhole shaped apertures and will be locked against inadvertant removal.

As best seen by referring to FIG. 5, selector bar 14 is substantially "U" shaped in configuration and is closely receivable in apertures 70 formed in each weight 22. As best seen by referring to FIGS. 2, 3 and 5, along its upper portion 14*a* bar 14 is provided with the previously identified keyhole shaped apertures 24 which are adapted to receive a second locking pin 72 (FIG. 3) which is of similar design to locking pin 54. As seen by also referring to FIG. 2, pin 72 is receivable in keyhole shaped apertures 74 formed in the side walls of housing 28 and can be extended through these apertures and then through apertures 24 formed in the selector bar to enable assembly 16 and selector bar 14 to be selectively interconnected together at various vertical starting heights. Pin 72, like pin 64, is also provided with a protuberance 76 which prevents accidental removal of the pin.

Along the lower portion 14*b* of selector bar 14 there is provided a plurality of vertically spaced apart keyhole shaped apertures 78 adapted to closely receive a third locking pin 80. As indicated in FIG. 2, each of the weights 22 is also apertured to closely receive locking pin 80. Apertures 78 in the selector bar are arranged to index with the apertures 81 in weights 22 when the selector bar is in its lowermost position. With this construction, pin 80 may be inserted into a selected aperture in the selector bar and will extend through the weight aligned therewith. In this way, one or more weights may readily be interconnected with the selector bar so that as assembly 16 is raised through exertion of an upward force on handle bar 40, the weights in the weight stack above pin 80 will also move upwardly relative to central column 20. Pin 80 is also provided with a protuberance 79 located intermediate its ends to prevent accidental withdrawal of the pin.

A further important feature of the apparatus of the present invention comprises a third guide means provided on guide column 20 for guiding the vertical travel of selector bar 14. In the present form of the invention, the third guide means comprises a track 82 affixed to the rear surface of the guide column (FIGS. 3 and 5). Track 82 has a pair of vertically extending spaced apart channels 84 adapted to slidably receive inturned end portions 86 formed on the side walls of selector bar 14. Although not shown in the drawings, other equivalent types of guide means such as cooperating rollers, slides and the like could, of course, also be used to operably interconnect the selector bar and central guide column 20.

OPERATION

In operating the apparatus of the invention, the trainee first adjusts assembly 16 relative to selector bar 14 so that the lifting arm is positioned at approximately the correct vertical starting height for the particular exercise to be performed. Next, if the trainee desires, a fine adjustment in the vertical height of the handle portions can be made by adjusting the handle bar to the assembly 16 in the manner previously described. Next, the trainee inserts selector pin 80 into the proper aperture in a given weight 22 to interconnect the desired number of weights with the selector bar 14. He thereupon, by exerting upward pressure on the handles 40*c* raises assembly 16, the selector bar 14 and the weights located above pin 80.

It is important to observe that as assembly 16 moves upwardly and downwardly, the central guide column not only constrains the path of travel of the assembly, but also of the selector bar 14 and the weights 22. The single central guide column construction of the apparatus provides a highly simple and effective mode of operation. The unique configuration of the device minimizes the number of component parts required, markedly reduces the weight of the unit and ensures safe, positive, reliable and trouble free operation.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example. We do not wish to be restricted to the specific forms shown or uses mentioned except as defined in the accompanying claims, wherein various portions have been separated for clarity of reading and not for emphasis.

We claim:

1. An exercising apparatus, comprising:

(a) a substantially vertically disposed selector bar;

(b) a reciprocating means connected to said selector bar for mutual reciprocal movement therewith;

(c) a plurality of weights, each of said weights having a centrally located aperture adapted to receive said selector bar;

(d) means for selectively interconnecting said selector bar with each of said weights;

(e) a substantially vertically disposed single central guide element having substantially vertically extending external surfaces closely receivable in said apertures formed in said weights, said central guide element being located adjacent to and externally from both said selector bar and said reciprocating means, said central guide element having means adapted for operable association with said selector bar to permit said selector bar to be guided along the outer surfaces of said central guide element, said central guide element being further adapted for operable association with said reciprocating means and including guide means for guiding reciprocal movement of said reciprocating means along a substantially vertical path said guide means comprising at least one of said external vertically extending external surfaces of said single central guide element; and (f) body engaging means projecting laterally outwardly from said reciprocating means for engagement by a trainee to impart vertically reciprocating movement thereto, whereby a lifting force exerted on said body engaging element tends to apply an eccentric force to said reciprocating means, said guide column being adapted to counteract the tendency to apply said eccentric force.

2. An exercising apparatus as defined in claim 1 in which said reciprocating means includes bearing means engageable with said guide means of said guide element.

3. An exercising apparatus as defined in claim 2 in which said bearing means comprises two sets of vertically spaced apart rollers adapted to rollably engage said guide means of said guide element at vertically spaced apart locations.

4. An exercising apparatus as defined in claim 1 in which said reciprocating means is vertically adjustable relative to said selector bar.

5. An exercising apparatus comprising:

(a) a vertically movable reciprocating means having first and second vertically spaced apart bearing means and including a substantially vertically depending selector bar adapted for mutual vertical movement therewith;

(b) a substantially vertically disposed single central guide element having first and second substantially vertically extending external surfaces for guiding said first and second bearing means of said reciprocating means, said central guide element being located externally from both said reciprocating means and said selector bar and having means adapted for operable association with said selector bar to permit said selector bar to be guided along the outer surface of said central guide element;

(c) a plurality of weights operably associated with said selector bar, said selector being adapted to be releasably interconnected with at least one of said weights for raising said weights upon upward movement of said reciprocating means; and (d) body engaging means projecting laterally outward from said reciprocating means for moving said means upwardly relative to said guide means, said body engaging means including grip portions and being adjustable relative to said reciprocating means whereby said grip portions can be adjusted to different vertical starting heights.

6. An exercising apparatus comprising:

(a) a single substantially vertically extending central guide element, said single guide element having at least one vertically extending external guide surface;

(b) reciprocating means operably associated with said guide element and adapted for reciprocal movement with respect thereto along a substantially vertical path, said reciprocating means including bearing means adapted to engage said external guide surface of said single guide element, said reciprocating means having additional means for mutual reciprocal movement therewith, said additional means being adapted for operable association with cooperating means on an outer surface of said guide element to permit said additional means to be guided along said central guide element during reciprocal movement of said reciprocating means;

(c) biasing means interconnected with said reciprocating means for yieldably resisting reciprocal movement thereof; and (d) laterally projecting body engaging means interconnected with said reciprocating means for engagement by a trainee to urge reciprocal movement of said reciprocating means against the urging of said biasing means whereby a lifting force exerted on said body engaging means tends to apply an eccentric force to said reciprocating means, said single guide element being adapted to counteract the tendency to apply said eccentric force.

7. An exercising apparatus as defined in claim 6 in which said additional means includes a substantially vertical depending selector bar disposed adjacent said single central guide element and in which said biasing means comprises at least one weight having a centrally disposed aperture therein, said selector bar being adapted to be releasably connected to said weight.

8. An exercising apparatus as defined in claim 6 in which said body engaging means includes grip portions and in which said body engaging means is adjustable relative to said reciprocating means whereby said grip portions can be positioned at varying vertical starting heights.

9. An exercising apparatus as defined in claim 8 in which said body engaging means is pivotally movable into various angular orientations relative to said reciprocating means.

10. An exercising apparatus comprising:

(a) a plurality of weights;

(b) a single substantially vertically extending central guide element;

(c) reciprocating means operably associated with said guide element and adapted for reciprocal movement with respect thereto along a substantially vertical path, said reciprocating means including a substantially vertical depending selector bar disposed adjacent said single central guide element and cooperating with said reciprocating means for mutual reciprocal movement therewith, said central guide element being located externally from both said reciprocating means and said selector bar and having means adapted for operable association with said selector bar for guiding the latter along an outer surface of said guide element during reciprocal movement of said reciprocating means, said selector bar being adapted to be releasably connected to each of said plurality of weights; and (d) laterally projecting body engaging means interconnected with said reciprocating means for engagement by a trainee to urge reciprocal movement of said reciprocating means against the urging of said weights connected to said selector bar whereby a lifting force exerted on said body engaging means tends to apply an eccentric force to said reciprocating means, said single guide element being adapted to counteract the tendency to apply said eccentric force.

* * * * *